US005156419A

United States Patent [19]

Minch

[11] Patent Number: 5,156,419

[45] Date of Patent: Oct. 20, 1992

[54] HINGE SYSTEM FOR ALBUMS

[75] Inventor: Paul A. Minch, Elyria, Ohio

[73] Assignee: The Chilcote Company, Cleveland, Ohio

[21] Appl. No.: 699,356

[22] Filed: May 13, 1991

[51] Int. Cl.[5] ..... B42D 1/00

[52] U.S. Cl. ..... 281/21.1; 281/2; 281/12; 462/7; 462/9

[58] Field of Search ..... 281/22, 21.1, 51, 2, 281/3.1, 9, 10, 12, 14; 462/7, 8, 9

[56] References Cited

U.S. PATENT DOCUMENTS

| | | | |
|---|---|---|---|
| 683,853 | 10/1901 | Forbes . | |
| 880,311 | 2/1908 | Krumming | 281/22 |
| 887,448 | 5/1908 | Willinger | 281/22 |
| 2,850,294 | 9/1958 | Ortis et al. . | |
| 3,461,585 | 8/1969 | Roberts . | |
| 3,533,646 | 10/1970 | Glasgow | 281/21.1 |
| 4,294,029 | 10/1981 | Holson . | |
| 4,601,489 | 7/1986 | Stancato . | |
| 4,768,810 | 9/1988 | Mertens | 281/51 |
| 5,066,183 | 11/1991 | Tholerus | 281/51 |

*Primary Examiner*—Timothy V. Eley
*Assistant Examiner*—Willmon Fridie, Jr.
*Attorney, Agent, or Firm*—Pearne, Gordon, McCoy & Granger

[57] ABSTRACT

A hinge system for an album, such as a photograph album, includes a plurality of leafs each having a backing layer. The backing layer of each album leaf is folded along its inner edge to form interlocking portions which engage corresponding portions on adjacent leafs to interconnect the leafs. An album cover assembly includes a bracket along the spine of the album for retaining at least one of the interlocking portions to hold the interconnected leafs in the album. The hinge system relies upon the elements formed by folding the backing layer of the album leafs and eliminates the need for additional binding or hinge elements, such as wires, posts or rods that add to the cost and complexity of the album leafs.

28 Claims, 2 Drawing Sheets

HINGE SYSTEM FOR ALBUMS

BACKGROUND OF THE INVENTION

1. Field of the Invention

This invention relates to books or albums such as albums for displaying photographs, and more particularly to hinges or bindings for such albums.

2. Description of the Prior Art

Books or albums, especially photograph albums, usually include a hinge system for binding the pages or leafs together with the cover in such a manner as to allow the pages or leafs to be assembled in any desired order and connected together in a hinge assembly. The hinge system should allow the pages or leafs to be securely held in place within the album, but should also allow the leafs to be easily assembled in any desirable order. In addition, the hinge system should allow the album to have a variable number of leafs, so that the album can be assembled with the desired number of leafs to fit particular needs.

Various hinge systems have been proposed for photograph albums. Examples of prior hinge systems for photograph albums are shown in the following U.S. Pat. Nos. 683,853, issued to Forbes; 2,850,294, issued to Ortis et al.; 3,461,585, issued to Roberts; 4,294,029, issued to Holson; and 4,601,489, issued to Stancato.

One conventional type of hinge system is the loose-leaf type binding in which the leafs are held in the album cover by binding posts, rings or other similar mechanical devices.

In another type of prior art hinge system, each of the album leafs have wires or posts projecting from each end of the inner edge. These wires fit within grooves in the album cover to hold the pages in place. However, these wires are difficult to insert and even more difficult to remove in the event that it is necessary to remove them. Furthermore, the construction of the album leafs requires that the wires be securely incorporated into the album leaf, and this results in a relatively expensive leaf construction.

Another system includes plastic hinge members formed at the inner edge of each album leaf. These hinge members interenegage to form a hinge system. However, this hinge system is relatively expensive to manufacture due to the numerous individual plastic members that must be made, and it is somewhat difficult to install. In addition, the plastic hinge devices may be relatively unreliable, and the hinges often become disengaged causing the pages of the album to fall out. Furthermore, the plastic members present a relatively unattractive appearance along the spine of the album which detracts from their desirability.

SUMMARY OF THE INVENTION

The disadvantages of the prior art album leafs are overcome by the present invention which provides a unique, simple and inexpensive hinge system, eliminating the need for the inclusion of wires or other hinge elements into the inner edge of the album leafs. Using the hinge system of the present invention, the album leafs can be constructed without using any additional hinge elements, such as wires, posts or interconnecting plastic members.

The hinge system of the present invention relies simply upon the use of the backing layers in the construction of the album leafs and thereby eliminates the need for additional elements that would add to the cost and complexity of the album leafs.

Furthermore, the hinge system of the present invention is easy to assemble and maintain. The album leafs are securely held in the album cover and are not easily pulled out inadvertently during use. However, the album leafs can be intentionally removed, if necessary, for rearrangement or replacement.

The advantages of the present invention are accomplished by folding the backing layer of the each album leaf along its inner edge into a plurality of parallel folds to produce interlocking elements along the inner edge. These interlocking elements engage corresponding elements on adjacent album leafs to connect the album leafs together in a unique and simple binding arrangement. To complete the hinge system of the present invention, a bracket is provided along the spine of the album between the front and back covers. The bracket holds the interlocked edges of the album leafs together so that they do not disengage and holds the album leaf inner edges to the spine of the album to provide a secure binding and hinge system.

Since the necessary hinge portions of each leaf can be produced simply by folding the backing layer of the leaf without adding any additional elements, the leafs can be produced far less expensively than album leafs of the prior art. In addition, the folding is accomplished by providing a plurality of parallel folds along the inner edge which can be done using automated folding equipment, so that manual operations in producing the album leafs are reduced or eliminated. Using automated folding equipment, and producing only a few parallel folds, the album leafs can be produced with great precision so that waste is reduced or eliminated.

The album leafs of the hinge system of the present invention are easily attached to the bracket without the mechanical interaction required by the prior art, so that there is less chance of the album hinge breaking or of the leafs loosening from the album during use. Yet, the leafs are easily and quickly assembled with the bracket by simply sliding the interlocking leafs lengthwise into the bracket, and the leafs can be easily removed by sliding them out, if it is necessary to remove them.

These and other advantages are achieved by the present invention of a hinge system for an album. The hinge system comprises a plurality of leafs each having a backing layer. The backing layer has an inner edge. The inner edge of the backing layer is folded into interlocking portions which engage corresponding portions on adjacent leafs to interconnect the leafs. The hinge system also comprises an album cover assembly having means for retaining at least one of the interlocking portions to hold the interconnected leafs in the album.

Preferably, the interlocking portions of the backing layer are a tab at the inner edge extending from one side of the leaf and a pocket at the inner edge extending from the other side of the leaf. The tab of one of the leafs is adapted to fit into the pocket of an adjacent one of the leafs to interlock the leafs together. The album cover assembly includes means for retaining at least one of the tabs to hold the leafs in the album.

DETAILED DESCRIPTION OF THE PREFERRED EMBODIMENT

Figure 1:
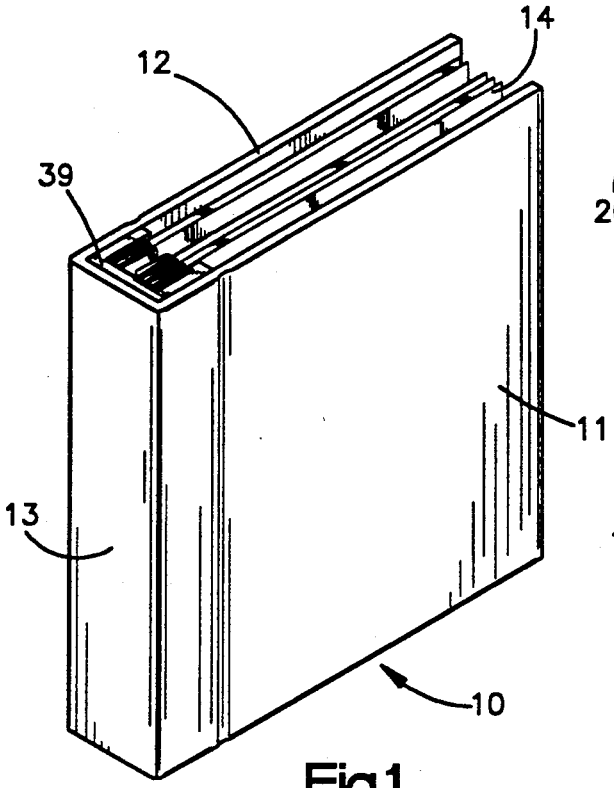
FIG. 1 is a perspective view of a photograph album having the hinge system of the present invention.

Referring more particularly to the drawings, and initially to FIG. 1, there is shown an album 10 having the hinge system of the present invention. The album 10 comprises a front cover 11 and a back cover 12 connected together by a spine assembly 13. The album 10 also comprises a plurality of leafs 14 each attached to the album at the spine assembly 13.

Figure 2:
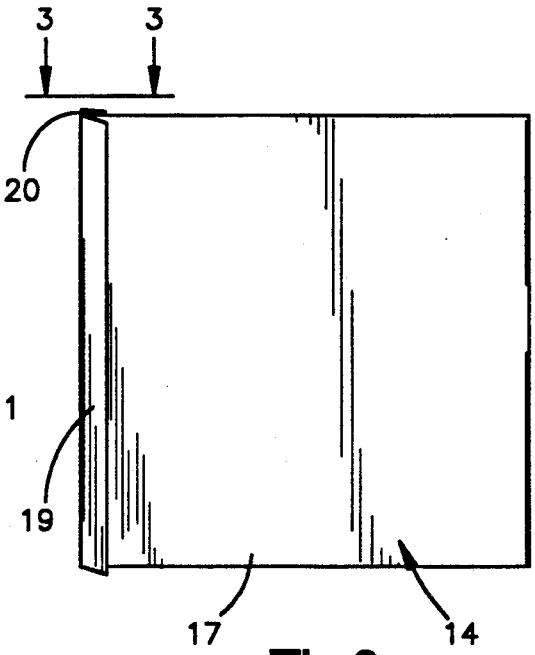
FIG. 2 is a side elevational view of one of the leafs of the album shown in FIG. 1 with the inner edge folded.

Each of the leafs 14 of the album 10 are identical and one of the leafs 14 is shown in more detail in FIG. 2. The leaf 14 comprises a generally rectangular base or backing layer 17 made of a relatively stiff cardboard material. The backing layer 17 may be finished in accordance with any known design or technique to form the finished album leaf. For example, the leaf 14 may be constructed in accordance with embossed frame layers and removable mat members as shown and described in U.S. patent application Ser. No. 07/519,503, filed May 7, 1990. The actual finish of the album leaf may vary and is not important to this invention.

Figure 3:
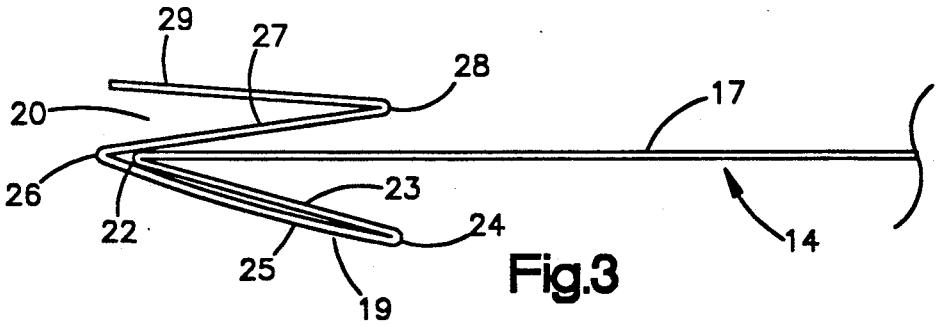
FIG. 3 is a top plan view of the inner edge of the leaf taken along line 3—3 of FIG. 2 showing the inner edge folded.
Figure 4:
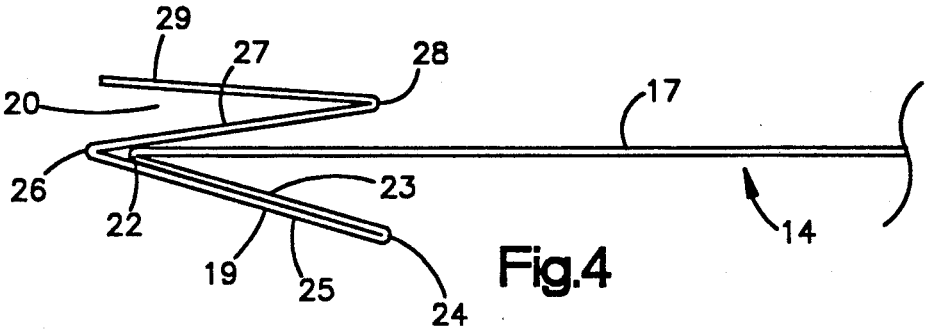
FIG. 4 is a top plan view of the inner edge of the leaf of FIG. 3 with the folded inner edge glued to form the tab and the pocket.

The inner edge of the backing layer 17 of the leaf 14 is folded and glued to provide interlocking portions which form part of the hinge system of the present invention. As shown in FIGS. 3 and 4, the inner edge of the leaf 14 has a outwardly extending tab 19 on one side and a corresponding outwardly facing pocket 20 on the other side. The tab 19 and the pocket 20 are formed by folding and gluing portions of the inner edge of the leaf 14 as shown in FIGS. 3 and 4.

Referring to FIG. 3, the inner edge of the backing layer 17 includes a first longitudinal fold 22 in which the backing layer 17 is folded back over itself. The first fold 22 forms one side of a first portion 23. The other side of the first portion 23 is formed by a second parallel fold 24, in which the backing layer is folded in the opposite direction as the first fold 22. The second fold 24 forms one side of a second portion 25 which extends parallel to the first portion 23. The other side of the second portion 25 is formed by a third parallel fold 26 in which the backing layer 17 is folded in the same direction as the second fold 24. The third fold 26 is located in the same approximate location as the first fold 22, and the third fold 26 forms one side of a third portion 27. The other side of the third portion 27 is formed by a fourth parallel fold 28, in which the backing layer is folded in the same direction as the first fold 22 and in the opposite direction as the second and third folds 24 and 26. The fourth fold 28 forms one side of a fourth portion 29. The other side of the fourth portion 29 is formed by the inner edge of the backing layer.

As shown in FIG. 4, the first and second portions 23 and 25 are glued together to form the tab 19 which forms part of the hinge system of the present invention. The third and fourth portions 27 and 29 together form the pocket 20 which is located on the opposite side of the leaf 14 from the tab 19.

Figure 5:
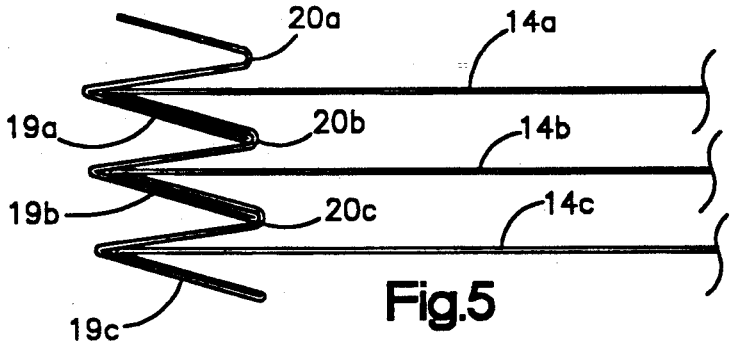
FIG. 5 is a top plan view showing the leaf of FIG. 3 interlocked with a plurality of other leafs.

As shown in FIG. 5, the tab 19*b* of one leaf 14*b* fits within the pocket 20*c* of the adjacent leaf 14*c*. The pocket 20*c* of the adjacent leaf 14*c* holds the tab 19*b* of the leaf 14*b* in place and prevents the leaf 14*b* from being pulled out of the album as long as the leaf 14*c* is held in the album. All of the leafs 14 of an album are interconnected in this manner to form the hinge system of the present invention.

Figure 7:
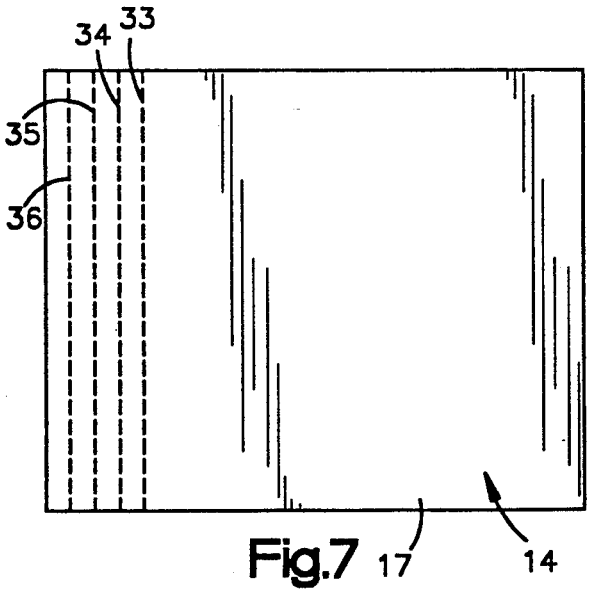
FIG. 7 is a side elevational view of leaf of FIG. 2 prior to folding.

Each of the album leafs 14 of the present invention are constructed from a single piece of a flat cardboard stock as shown in FIG. 7. A plurality of parallel perforations, cuts or scores are made adjacent to the inner edge of the leaf 14 to provide the various folds used to form the portions of the leaf. A perforation 33 is cut to form the first fold 22. Next to the perforation 33 is a cut score 34 which is used to form the second fold 24. Simple scores 35 and 36 are provided next to the cut score 34 to form the third and fourth folds 26 and 28, respectively. Each of the perforations or scores 33, 34, 35 and 36 are formed in a single cutting operation in accordance with techniques well known in the art, and may be formed in same operation in which the peripheral edges of the leaf 14 are cut from the stock. After the perforations or scores 33, 34, 35 and 36 have been made, the inner edge of the leaf 14 may be folded to produce the folds 22, 24, 26 and 28 using automated folding machines as are also well known in the art.

Figure 6:
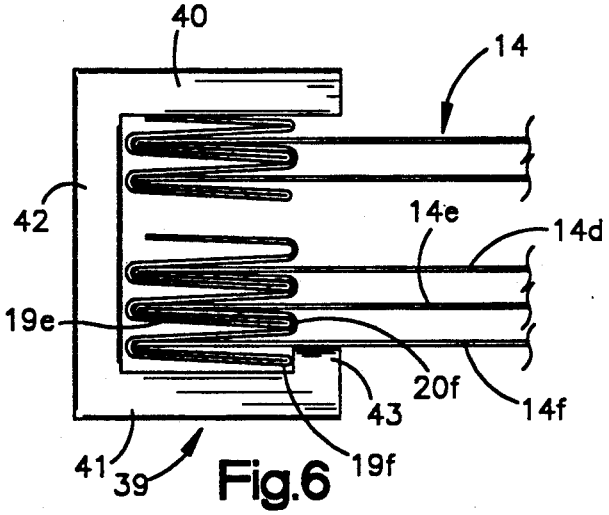
FIG. 6 is a top plan view showing the plurality of leafs of FIG. 5 in combination with the hinge bracket.

As shown in FIGS. 1 and 6, the spine assembly 13 of the album 10 includes a bracket 39 which also forms part of the hinge system and which holds the leafs 14 together and connects the leafs to the front and back covers 11 and 12 of the album. The bracket 39 has a generally C-shaped cross section with side portions 40 and 41 and a back or spine portion 42. One of the side portions 41 has a lip 43 extending inwardly toward the other side portion 40 from the outerwardly extending edge of the side portion 41. The edges of the leafs 14 are inserted into the bracket 39 and are held therein. As shown in FIG. 6, the tab 19*f* of the final leaf 14*f* engages the lip 43 to keep the leaf 14*f* from being pulled from the bracket 39 and to keep the leaf 14*f* from pulling out of the album hinge. The pocket 20*f* of the leaf 14*f* also engages the tab 19*e* of the next leaf 14*e* thereby holding that leaf 14*e* in the album. In this manner all of the leafs 14 are held together in the bracket 39. All of the leafs 14 are compressed together by the C-shaped bracket 39 so that the tabs 19 and pockets 20 do not disengage.

Figure 8:
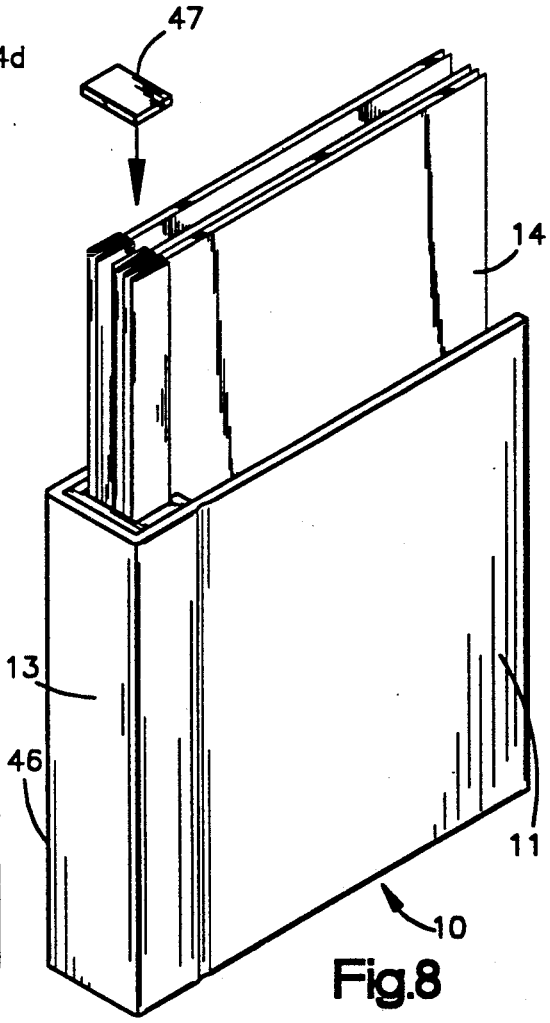
FIG. 8 is a perspective view similar to FIG. 1 showing the assembly of an album using the hinge system of the present invention.

To assemble the album 10 of the present invention, the user selects the number and type of desired album leafs 14 from an available assortment of different types of leafs. The leafs may differ in matting arrangement, color and other characteristics. Each of the album leafs 14 is manufactured in accordance with the invention, so that the backing layer 17 of each leaf is folded along the inner edge and glued to form a tab 19 and pocket 20. The user then arranges album leafs 14 in the desired order and interengages the tabs 19 and the pockets 20 of the leafs so that the leafs are properly interlocked. The user then takes the interlocked leafs 14 together and slides the interlocked inner edges of the leafs lengthwise into the bracket 39 which has been preassembled with the front and back covers 11 and 12 and the spine assembly 13 to form an album cover assembly 46 as shown in FIG. 8. After the leafs 14 have been aligned in the bracket 39, the ends of the bracket may be covered or sealed using any suitable means such as the end caps 47 shown in FIG. 8 to prevent the leafs from sliding out of the album in use. The assembly of the album 10 is then complete and the album is ready for use.

If it is necessary to remove the leafs 14 from the album cover assembly 46 for any reason, such as to rearrange the order of the leafs or to replace a leaf, the leafs can be easily removed by removing one of the end caps 47 and sliding the interlocked leafs from the bracket 39. After rearrangement or replacement, the leafs 14 can be reinserted into the bracket 39 as previously described.

As can be seen, the present invention provides a hinge system which is easily and inexpensively produced by simply folding the backing layer of the album leafs into a plurality of folds and without the necessity of adding wires or other elements to the album leaf construction which would otherwise increase the complexity and cost of the album leafs. The present invention contemplates other forms of folding of the cardboard material of the backing layer to produce an interlocking design, but the tab and pocket design described above is preferred due to its simplicity and effectiveness.

While the invention has been shown and described with respect to a particular embodiment thereof, this is for the purpose of illustration rather than limitation, and other variations and modifications of the specific embodiment herein shown and described will be apparent to those skilled in the art, all within the intended spirit and scope of the invention. Accordingly, the patent is not to be limited in scope and effect to the specific embodiment herein shown and described nor in any other way this is inconsistent with the extent to which the progress in the art has been advanced by the invention.

What is claimed is:

1. A hinge system for an album, comprising:

a plurality of leafs each having a backing layer, the backing layer having an inner edge, the leafs having nonadhesive means for removably holding the leafs together and preventing the leafs from being pulled out of the album, the nonadhesive holding and preventing means including interlocking portions, the inner edge of the backing layer being folded into interlocking portions which mechanically engage corresponding portions on adjacent leafs to interconnect the leafs; and an album cover assembly having means for retaining at least one of the interlocking portions to hold the interconnected leafs in the album.

2. A hinge system as defined in claim 1, wherein the interlocking portions are a tab and a pocket extending from opposite sides of the backing layer.

3. The hinge system as defined in claim 1, wherein the backing layer is folded into a first fold, a second fold, a third fold and a fourth fold.

4. The hinge system as defined in claim 3, wherein each of the folds is parallel to each other.

5. The hinge system as defined in claim 3, wherein the first fold forms the tab.

6. The hinge system as defined in claim 3, wherein the third fold and the fourth fold form the pocket.

7. The hinge system as defined in claim 1, wherein the album cover assembly includes a bracket within which the inner edges of the leafs are held.

8. The hinge system as defined in claim 7, wherein the bracket includes a lip engaging one of the interlocking portions of one of the leafs to hold the interconnected leafs in the bracket.

9. The hinge system as defined in claim 7, wherein the bracket is generally C shaped in cross section.

10. A hinge system for an album, comprising:

a plurality of leafs each having a backing layer, the backing layer having an inner edge, the backing layer having a tab at the inner edge extending from one side of the leaf and a pocket at the inner edge extending from the other side of the leaf, the tab of one of the leafs adapted to fit into the pocket of an adjacent one of the leafs to interlock the leafs together; and an album cover assembly having means for holding the inner edges of the leafs and for retaining at least one of the tabs to hold the leafs in the album.

11. The hinge system as defined in claim 10, wherein the tab and the pocket are formed by folding the inner edge of the backing layer into a plurality of parallel folds.

12. The hinge system as defined in claim 11, wherein the folds include a first fold, a second fold, a third fold and a fourth fold.

13. The hinge system as defined in claim 12, wherein the first fold forms the tab.

14. The hinge system as defined in claim 12, wherein the third fold and the fourth fold form the pocket.

15. The hinge system as defined in claim 10, wherein the album cover assembly includes a bracket within which the inner edges of the leafs are held.

16. The hinge system as defined in claim 15, wherein the bracket includes a lip engaging the tab of one of the leafs to hold the interconnected leafs in the bracket.

17. The hinge system as defined in claim 15, wherein the bracket is generally C shaped in cross section.

18. An album comprising:

a front cover;

a back cover;

a plurality of leafs between the front cover and the back cover, each of the leafs having an inner edge; and a hinge system connecting the front cover and the back cover and holding the inner edge of each of the leafs, the hinge system comprising a pocket extending along the inner edge of each of the leafs, a tab extending along the inner edge of each of the leafs, the tab of each leaf fitting within the pocket of an adjacent leaf to hold the leafs in place together, and a bracket attached to the front cover and the back cover within which the inner edges of the leafs are held.

19. The album as defined in claim 18 wherein the bracket includes a lip engaging the pocket or the tab of one of the leafs to hold the interconnected leafs in the bracket.

20. The album as defined in claim 18, wherein the bracket is generally C shaped.

21. The album as defined in claim 18, wherein the tab and the pocket are formed by providing a plurality of parallel folds in the leafs along the inner edges.

22. The album as defined in claim 21, wherein the tab and the pocket are formed by providing a first fold, a second fold, a third fold and a fourth fold along the inner edge of each leaf.

23. The album as defined in claim 22, wherein the first fold and the second fold form the tab.

24. The album as defined in claim 22, wherein the third fold and the fourth fold form the pocket.

25. The album as defined in claim 22, wherein the first fold is made in the direction of the tab.

26. The album as defined in claim 25, wherein the second fold is made in the opposite direction as the first fold, the first and second folds defining a first portion.

27. The album as defined in claim 26, wherein the third fold is made in the same direction as the second fold, and the third fold is made at the approximate location of the first fold, the second and third folds defining a second portion, the first and second portions capable of being adhered together to form the tab.

28. The album as defined in claim 27, wherein the fourth fold is made in the opposite direction as the third fold, the third and fourth fold defining a third portion, the fourth fold and the inner edge defining a fourth portion, the third and fourth portion forming the pocket.

* * * * *